US009561517B2

(12) United States Patent
Wertheim et al.

(10) Patent No.: US 9,561,517 B2
(45) Date of Patent: Feb. 7, 2017

(54) TAMPER-PROOF AND LIGATION RESISTANT DISPENSER FOR LIQUIDS

(71) Applicant: Archer Manufacturing, Inc., Danville, CA (US)

(72) Inventors: Mark Wertheim, Danville, CA (US); Andrew Wertheim, Danville, CA (US)

(73) Assignee: Archer Manufacturing, Inc., Danville, CA (US)

( * ) Notice: Subject to any disclaimer, the term of this patent is extended or adjusted under 35 U.S.C. 154(b) by 369 days.

(21) Appl. No.: 14/092,632

(22) Filed: Nov. 27, 2013

(65) Prior Publication Data

US 2015/0144660 A1 May 28, 2015

(51) Int. Cl.

| | |
|---|---|
| ***B67D 7/06*** | (2010.01) |
| ***B05B 11/00*** | (2006.01) |
| ***A47K 5/12*** | (2006.01) |
| ***A47K 5/14*** | (2006.01) |

(52) U.S. Cl.

CPC ..... *B05B 11/0037* (2013.01); *A47K 5/1202* (2013.01); *A47K 5/14* (2013.01)

(58) Field of Classification Search

CPC ..... A47K 5/1211; A47K 5/1202; A47K 5/14; B05B 11/3056; B05B 11/0037

USPC ..... 222/181.1–181.3

See application file for complete search history.

(56) References Cited

U.S. PATENT DOCUMENTS

| | | | | |
|---|---|---|---|---|
| 5,207,355 | A | 5/1993 | Thomsen | |
| 5,443,236 | A | 8/1995 | Bell et al. | |
| 6,619,509 | B2 * | 9/2003 | DeKoning | A47K 5/12 222/183 |
| 6,644,516 | B1 | 11/2003 | Foster et al. | |
| 6,668,873 | B1 | 12/2003 | Wertheim | |
| 6,877,642 | B1 | 4/2005 | Maddox et al. | |
| 8,245,881 | B2 * | 8/2012 | Ophardt | B67D 1/0004 222/181.1 |
| 8,505,776 | B2 | 8/2013 | Criswell et al. | |
| 8,528,787 | B2 | 9/2013 | Cittadino et al. | |
| 2013/0112714 | A1 | 5/2013 | Ho | |

OTHER PUBLICATIONS

Norva Plastics; Suicide Prevention Soap Dispenser; http://norvaplastics.com/suicide-prevention-soap-dispenser.asp; 1 page; downloaded Feb. 13, 2014.

(Continued)

*Primary Examiner* — Patrick M Buechner

(74) *Attorney, Agent, or Firm* — Fitch, Even, Tabin & Flannery LLP

(57) ABSTRACT

A tamper-proof and ligation-resistant apparatus for dispensing a liquid from a liquid container contained within a dispenser. The apparatus includes a back housing, a cover pivotally coupled to the back housing, a liquid cartridge coupled to the back housing, and an actuator coupled to the cover. The apparatus includes plates coupled to the cover and back housing to strength the apparatus or reduce gaps to prevent ligation. The actuator includes a dispensing hole small enough to prevent ligation. A pump nozzle insert compressibly fitted inside the pump nozzle reduces the liquid stream diameter and extends the pump nozzle so that the liquid stream passes through the dispensing hole unimpeded.

1 Claim, 10 Drawing Sheets

(56) References Cited

OTHER PUBLICATIONS

Vandal Stop Products; SD-Push Front: Technical Data Sheet; http://www.atlasamerican.com/specsheets/SD-PushFront.pdf; 1 page; downloaded Feb. 13, 2014.
Gojo Industries, Inc.; Gojo FMX Security Enclosure; http://gojo.com/united-states/productdisplay.aspx?ProdID=(76BA1C56-9DB0-4AF3-9CE1-1443F352C91C); 1 page; downloaded Feb. 18, 2014.

* cited by examiner

TAMPER-PROOF AND LIGATION RESISTANT DISPENSER FOR LIQUIDS

BACKGROUND OF THE INVENTION

1. Field of the Invention

The present invention relates generally to liquid dispensers, and more specifically to tamper and ligation resistant wall-mounted liquid dispensers.

2. Discussion of the Related Art

There are many dispensers known to the art for dispensing liquid soap or other liquid material. These dispensers are used in a number of applications, including: soap dispensers in restrooms, beverage dispensers, liquid dispensers at gas stations, etc. Dispensers are used in self-service types of environments where a product is needed and it is uneconomical or undesirable to have a full-time attendant. Typically, a user activates the dispenser and an internal mechanism accesses a supply of the product. The product is removed from the internal supply and provided to the user. Since the internal supply is not unlimited, dispensers usually include some type of cover or door that allows an operator to access the internal area of a dispenser, for example for maintenance tasks or restocking of product.

More particularly, there are many "bag-in-box" type wall-mounted dispensers in which the liquid soap or other material is contained in a flexible bag. The dispenser typically includes a vertically disposed base or mounting plate which can be secured to a wall or other vertical surface, and a pivoting cover which is hinged or otherwise attached to the base and is swingable between an open and closed position. When the cover is in an open position, the liquid bag is coupled to the liquid dispensing means. The cover is then closed, securing the liquid bag inside the dispenser.

The liquid dispenser may also include means for securing the cover to the base, for example a locking mechanism including a key, in order to prevent vandalism or tampering.

SUMMARY OF THE INVENTION

Several embodiments of the invention advantageously address the needs above as well as other needs by providing an apparatus for dispensing a liquid stream comprising: a back housing comprising a back plate and a cartridge support assembly coupled to the back plate; a latch plate coupled to the back plate; a liquid cartridge coupled to the cartridge support assembly, the liquid cartridge comprising a pump and a liquid container including a liquid, the liquid container in fluid communication with the pump; a cover including a cover opening proximate to a lower portion of the cover, the lower portion of the cover pivotally coupled to a lower portion of the back housing such that the cover automatically pivots away from the back housing into an open position, and such that the liquid cartridge is entirely enclosed within a profile of the apparatus when the cover is in a closed position, whereby the liquid cartridge is inaccessible to a user when the cover is in the closed position; a latch coupled to the cover, whereby the latch may be removably coupled to the latch plate when the cover is in the closed position such that the cover is secured to the back housing in the closed position; and an actuator including a dispensing hole, the actuator pivotally coupled to an interior face of the cover such that a lower portion of the actuator is accessible through the cover opening, whereby the pump is actuated and the liquid stream is dispensed though the dispensing hole.

In another embodiment, the invention can be characterized as a pump nozzle insert configured to be wedgingly received by a pump nozzle of a pump, the pump nozzle insert including a dispensing bore configured for conveying and discharging a stream dispensed by the pump when the pump is actuated, whereby a diameter of a dispensed stream exiting the pump nozzle insert is smaller than a diameter of the dispensed stream exiting the pump.

In a further embodiment, the invention can be characterized as a An actuator pivotally coupled to a liquid dispenser housing comprising: a front plate; a left flange plate integrally coupled to a left edge of the front plate, the left plate plate extending in a direction of a liquid dispenser housing interior in an orientation generally normal to the front plate, the left flange plate configured to cover a gap between the actuator and the liquid dispenser housing when the actuator is pivoted, whereby the structural strength of the actuator to resist an applied force is increased and ligation is prevented; a right flange plate integrally coupled to a right edge of the front plate, the right plate plate extending in a direction of a liquid dispenser housing interior in an orientation generally normal to the front plate, the right flange plate configured to cover a gap between the actuator and the liquid dispenser housing when the actuator is pivoted, whereby the structural strength of the actuator to resist an applied force is increased and ligation is prevented; a bottom plate integrally coupled to a bottom edge of the front plate, the bottom plate extending in a direction of a liquid dispenser housing in an orientation generally perpendicular to the front plate the bottom plate configured to cover a ligation gap between the actuator and the liquid dispenser when the actuator is pivoted, the bottom plate further including a dispensing hole, the dispensing hole including a maximum dispensing hole dimension of 0.35 inches, the bottom plate configured to cover a gap between the actuator and the liquid dispenser housing when the actuator is pivoted, whereby the structural strength of the actuator to resist an applied force is increased and ligation is prevented.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
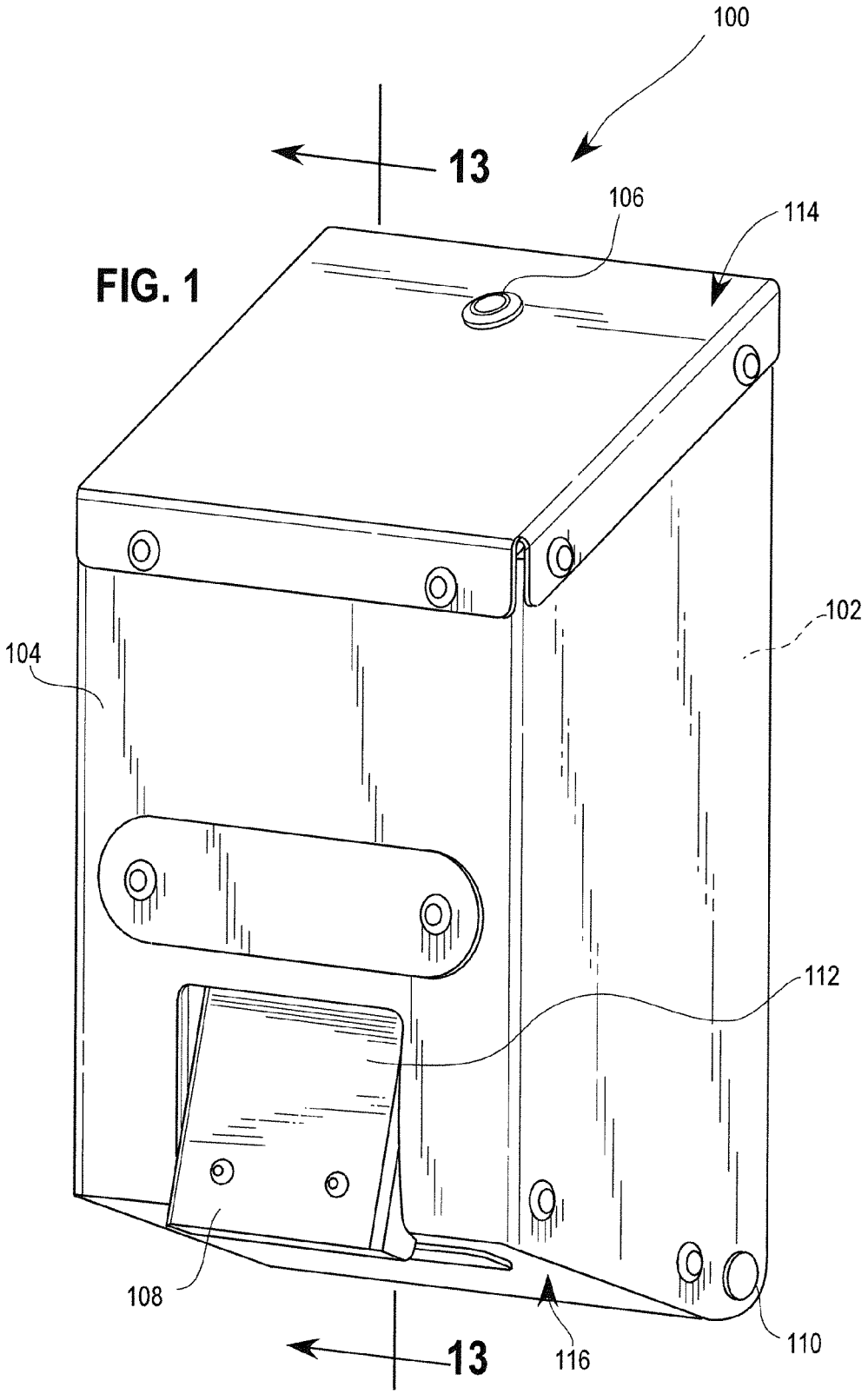
FIG. 1 is a perspective view of a liquid dispenser in the closed position.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Referring first to FIG. 1, a perspective view of a liquid dispenser 100 in a closed position, in one embodiment of the invention is shown. Shown are the liquid dispenser 100, a back housing 102, a cover 104, a locking mechanism 106, an actuator 108, a pivot bolt 110, a cover opening 112, a liquid dispenser top surface 114, and a liquid dispenser bottom surface 116.

The liquid dispenser 100 includes the back housing 102 and the cover 104 configured to hold and dispense a liquid (not shown). A lower portion of the cover 104 is pivotally coupled to a lower portion of the back housing 102 with two pivot bolts 110, one pivot bolt 110 on each side of the cover 104, so that the cover is automatically rotated downward and away from the back housing 102 when the locking mechanism 106 is in an unlocked configuration, as shown below in FIG. 2.

In the present embodiment, the back housing 102, the cover 104 and the actuator 108 are comprised of stainless steel plates, with thicknesses of approximately 14-16 gauge.

The locking mechanism 106 is coupled to the liquid dispenser top surface 114, and is configured for securing the cover 104 to the back housing 102 when the liquid dispenser 100 is in the closed position shown in FIG. 1. When the locking mechanism 106 is released, the cover 104 is automatically rotated about the pivot bolts 110 so that the liquid dispenser 100 is in an open position (as shown below in FIG. 2).

The cover 104 includes the cover opening 112 located in the lower portion of the cover 104 such that the actuator 108 is received within the cover opening 112 and pivotally hinged to an upper portion of an interior face of the cover 104, as shown in more detail below in FIG. 13. The outward and inward rotation of the actuator 108 is limited by contact of the actuator 108 with the cover 104 when the actuator 108 is rotated in either direction.

Referring again to FIG. 1, the liquid dispenser 100 in the closed position is shown. The liquid dispenser 100 is operated conventionally, with a liquid cartridge 200 (as shown below in FIGS. 12, 14) disposed so that a pump nozzle 1106 is near to or in contact with an interior face of the actuator 108. When the actuator 108 is pushed, the pump 202 is activated, dispensing the liquid through the pump nozzle 1106 and through the cover opening 112 to a user (not shown). The amount of the liquid dispensed is limited by the pump 202 configuration and also by configuring the cover 104 so that the actuator contacts the cover 104 after the pump 202 has been pushed inward a prescribed distance, halting the flow of liquid (as described further below in FIG. 13).

However, conventional liquid dispensers as shown in the prior art are not suitable for installation in a high-security facility, such as a prison, where tampering, vandalism and ligation are concerns. The present invention advantageously includes a number of innovations to increase the structural strength of the liquid dispenser 100 to prevent tampering of and vandalism to the liquid dispenser 100, and prevent ligation caused by securing a ligature in an opening, crevice or gap of the liquid dispenser 100, as described in more detail below. The structural strength of the dispenser 100 is defined as the measure of the ability of the dispenser to resist breakage or deformation when subjected to expected applied forces, for example, the forces applied by a person attempting to pry, fracture, or bend the dispenser 100.

A plurality of plates comprising the liquid dispenser 100 are comprised of stainless steel, providing resistance to vandalism and tampering. Those skilled in the art will note that the design may be modified for use with other suitably structurally strong and corrosion-resistant materials, such as mild steel or aluminum. The dispenser 100 may also be configured to receive paint or a coating, for example a powder coating. In the embodiment shown, the plate edges are generally rounded or smoothed.

The configuration of the liquid dispenser 100 is such that the liquid cartridge 200, which includes a liquid container 204 and the pump 202, is entirely enclosed within a perimeter of the liquid dispenser 100 when the liquid dispenser 100 is in the closed position, reducing the possibility of tampering with or removal of the pump 202 or liquid container 204. The term "ligation gap" is herein defined as a gap between members or portions of the liquid dispenser which is wide enough to wedgingly receive an article available to the person in the high-security facility, for example, a shoelace.

The locking mechanism 106 prevents the liquid cartridge 200 from being opened without an unlocking device (not shown), further preventing tampering, vandalism or possible ligation. The locking mechanism 106 is described further below in FIG. 5.

Figure 2:
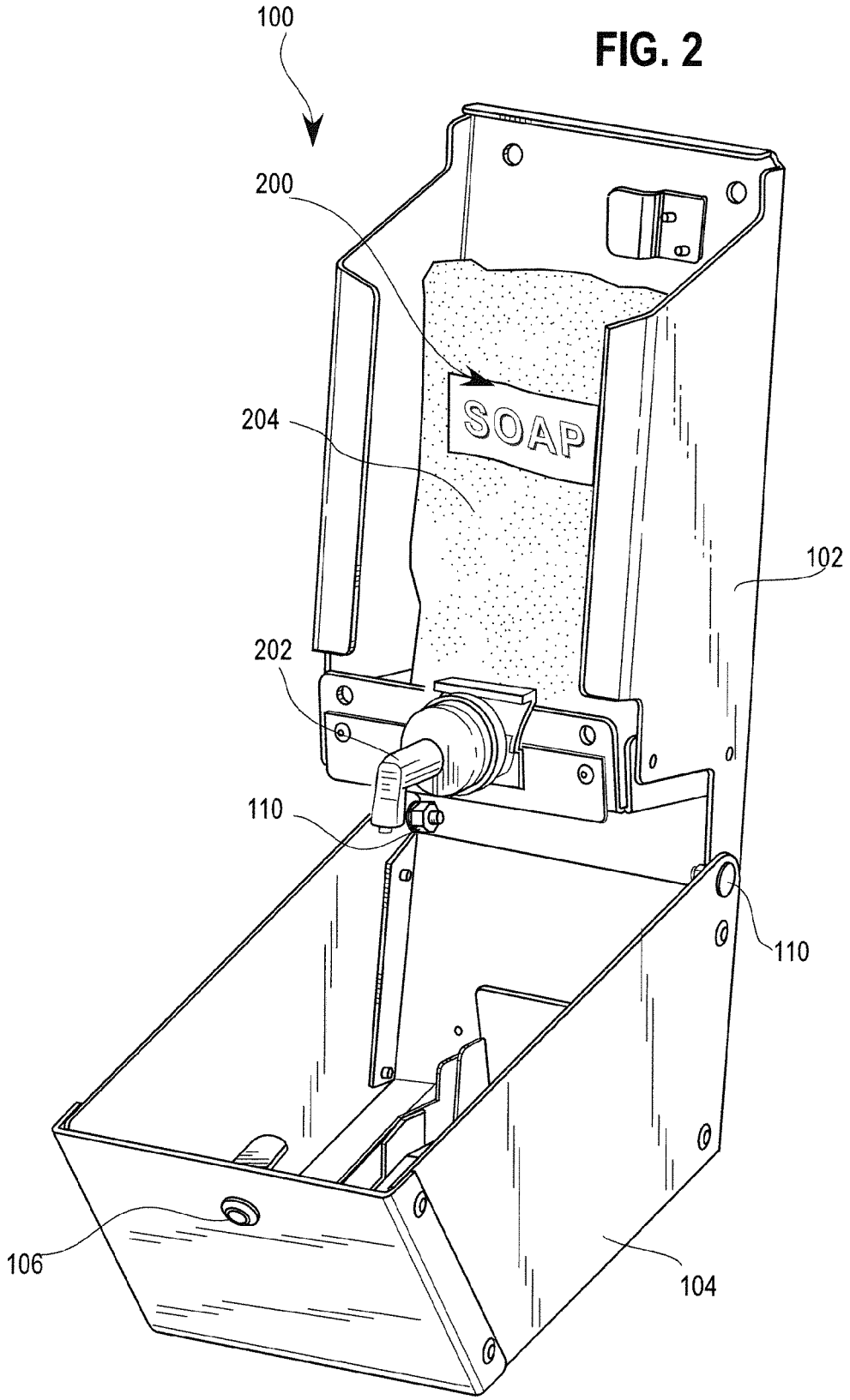
FIG. 2 is a perspective view of the liquid dispenser in the open position.

Referring next to FIG. 2, a perspective view of the liquid dispenser 100 in the open position is shown. Shown are the liquid dispenser 100, the back housing 102, the cover 104, the locking mechanism 106, the pivot bolt 110, the liquid cartridge 200, the pump 202, and the liquid container 204.

As described previously in FIG. 1, when the locking mechanism 106 is in the unlocked configuration, due to the location of the pivot bolts 110 proximate to a bottom of the liquid dispenser 100, the cover 104 automatically rotates outward and downward when the back housing 102 is coupled to a vertical surface, for example, a wall (not shown).

The liquid cartridge 200 includes the pump 202 and the liquid container 204. The liquid container 204 is in fluid communication with the pump 202 to allow the liquid to flow through the pump 202 when the pump 202 is activated. The liquid cartridge 200 is demountably coupled to the back housing 102 so that the pump 202 is positioned for activation by the actuator 108 when the liquid dispenser 100 is in the closed position. The liquid container 204 is of a size, shape and material suitable for use in the present embodiment of the invention. In the embodiment shown, the liquid container 204 is a bag-type container comprising a thin plastic, for example, PET.

Referring again to FIG. 2, the liquid dispenser 100 is shown in the unlocked configuration, resulting in the open position. The automatic rotation of the cover 104 allows for access to the liquid cartridge 200 for maintenance or replacement. While in the present embodiment the entire liquid cartridge 200 is replaced to prevent cross-contamination of bacteria, those skilled in the art will note that alternate embodiments include the pump demountably coupled to the liquid container 204, so that one may be replaced without replacing the other.

Figure 3:
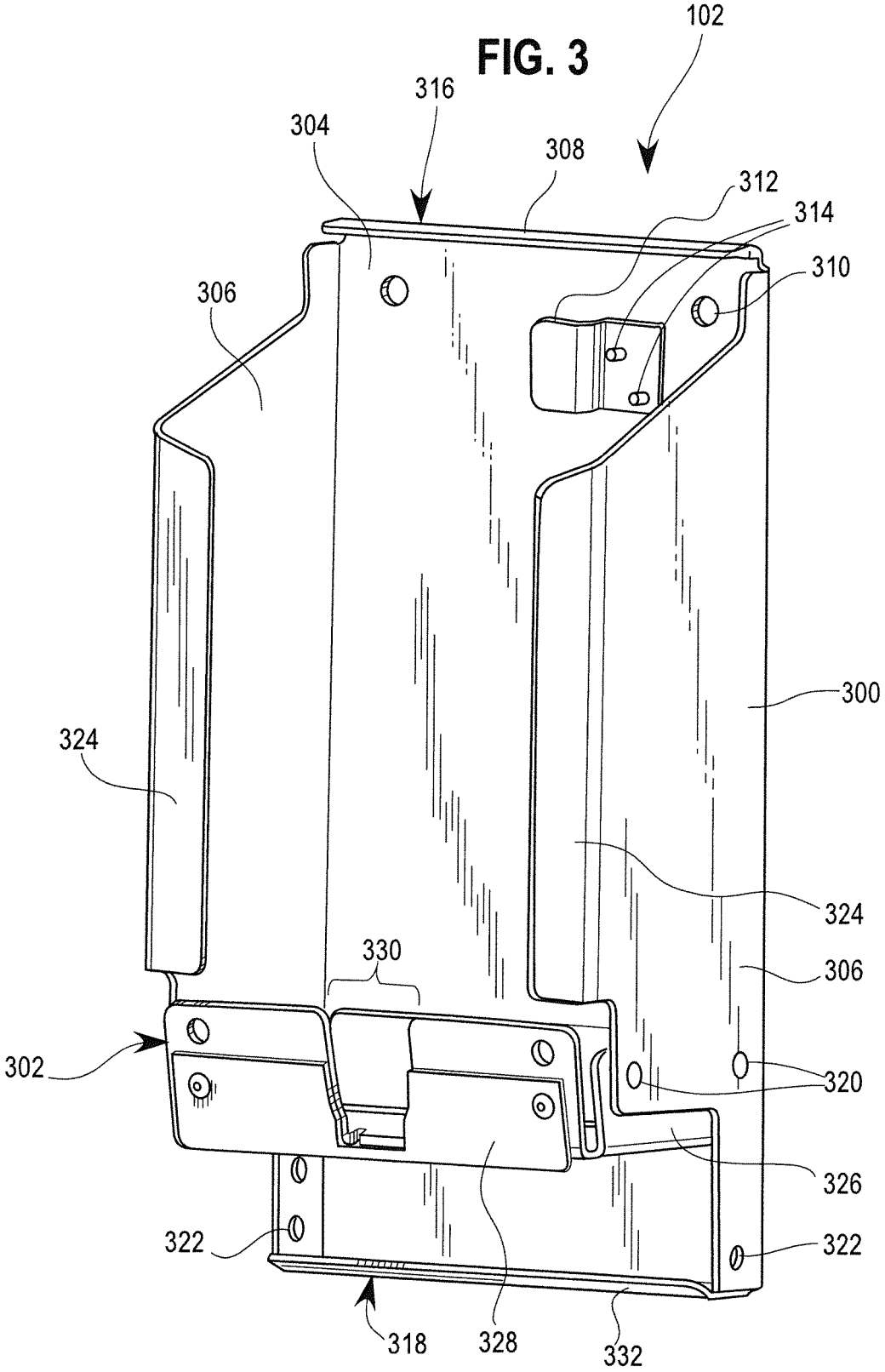
FIG. 3 is a perspective view of a back housing of the liquid dispenser.

Referring next to FIG. 3, a perspective view of the back housing 102 of the liquid dispenser 100 is shown. Shown are the back housing 102, a back plate 300, a cartridge support assembly 302, a back plate rear wall 304, a plurality of back plate side walls 306, a back plate top flange 308, a plurality of mounting holes 310, a latch plate 312, a plurality of latch plate rivets 314, a back housing top edge 316, a back housing bottom edge 318, a plurality of rivet holes 320, a hinge hole 322, a plurality of back plate front flanges 324, a cartridge support plate side wall 326, a cartridge support plate front wall 328, and a pump cutout 330, and a back plate bottom flange 332

The back housing 102 includes the back plate 300 and the cartridge support assembly 302. The back plate 300 is shaped to form a general vertical channel-shape, with the opening of the channel facing outward and the channel walls generally perpendicular to the channel base. The back plate rear wall 304 corresponds to the base of the channel shape, and the two back plate side walls 306 correspond to the two channel walls.

The back plate rear wall 304 comprises 14-gauge stainless steel, and is generally rectangular-shaped, with the addition of the back plate top flange 308 extending outward from a top edge of the back plate 300 in a generally perpendicular direction, and the back plate bottom flange 332 extending outward from a bottom edge of the back plate 300 in a generally perpendicular direction.

The back plate rear wall 304 includes the plurality of mounting holes 310 used for coupling the liquid dispenser 100 directly to the vertical support. It will be obvious to those skilled in the art that the size and location of the mounting holes 310 are dependent on the type of mounting equipment (for example, screws, drywall anchors or masonry anchors) and type of vertical support structure to be mounted to, for example, wood studs, drywall or concrete masonry units.

The latch plate 312 comprises 14-gauge stainless steel, is coupled to the back plate rear wall 304 and includes a lateral jog. In the present embodiment, one end of the latch plate 312 is coupled to an interior face of the back plate rear wall 304 using at least one hollow latch plate rivet 314. In the present embodiment, two latch plate rivets 314 are used. The latch plate rivets 314 are installed so that the end of a latch plate rivet shaft is generally flush with an exterior face of the back plate rear wall 304. The latch plate 312 is coupled to the back plate rear wall 304 to provide a latch point for the locking mechanism 106 when the liquid dispenser 100 is closed and the locking mechanism 106 is in the locked configuration. It should be noted that while a latching mechanism is shown, alternate methods of securing the cover 104 to the back housing 102 may be used.

The two back plate side walls 306 extend outward in a generally perpendicular direction from the back plate rear wall 304. The back plate side walls 306 include a narrow portion proximate to the back housing top edge 316, then slope steeply outward to approximately 2.75" in width. Proximate to a top extent of the cartridge support assembly 302, the width of each back plate side wall 306 decreases to approximately 2.5". Proximate to a bottom extent of the cartridge support assembly 302 the width of each back plate side wall 306 decreases to about 1.25".

Each back plate side wall 306 includes the hinge hole 322 proximate to the back housing bottom edge 318 for receiving the pivot bolts 110 shown in FIGS. 1, 2. The back plate side walls 306 also include a plurality of rivet holes 320 sized and located for coupling the cartridge support assembly 302 to the back plate 300 using a plurality of rivets 600 (not shown). It should be appreciated that the size, number and location of rivets 600 may vary depending on the type and size of rivets 600 used, the thicknesses of the plates, the spacing of the rivets 600, and other connection variables.

Each back plate side wall 306 includes the integral back plate front flange 324 extending inward perpendicular to the back plate side wall 306 at an edge of the back plate side wall 306 distal to the back plate rear wall 304. The back plate front flange 324 is generally included for a widest segment of the back plate side wall 306.

The cartridge support assembly 302 is formed in a shallow rectangular tray shape. Each cartridge support plate side wall 326 is coupled to the corresponding back plate side wall 306. The cartridge support plate front wall 328 includes a generally u-shaped pump cutout 330. The cartridge support assembly 302 is described further below in FIG. 4.

Referring again to FIG. 3, the back housing 102 is generally configured to provide a structurally strong, mountable base for the pivoting cover 104, be capable of receiving the locking mechanism 106 of the cover 104, and support the liquid cartridge 200 in the position required to dispense the liquid to the user, while ensuring that the liquid cartridge 200 is entirely enclosed by the perimeter of the liquid dispenser 100 when the liquid dispenser 100 is in the closed position.

The shape of the back plate 300, a general vertical channel, provides a holding cavity for the liquid cartridge 200. The back plate side walls 306 prevent the liquid cartridge 200 from coming into contact with the liquid cartridge 200 when the liquid dispenser 100 is closed, and protects the liquid container 204 from puncture. In addition, the back plate side walls 306 increase the structural strength of the back housing 102.

The back plate 300 also includes the back plate bottom flange 332, which advantageously reduces a bottom gap between the back housing bottom edge 318 and a bottom of the cover 104, preventing tampering and a ligation point, as shown further below in FIG. 10.

Similarly, the back plate top flange 308 reduces a top gap between the back housing top edge 316 and a top of the cover, preventing tampering and a ligation point.

The back plate rear wall 304 includes the plurality of mounting holes 310 for securing the liquid dispenser 100 to the vertical support. The liquid dispenser 100 is coupled directly to the vertical support without the use of an intermediate wall mounting bracket, advantageously preventing the possibility of removal of the liquid dispenser 100 as a result of tampering with the intermediate wall mounting bracket.

The latch plate 312 coupled to the back plate rear wall 304 provides a secure latch point for the locking mechanism 106 attached to the cover 104. The use of latch plate rivets 314 to attach the latch plate 312 to the back plate rear wall 304, and providing a latch plate 312 comprised of steel, secures the cover 104 against removal due to bending or detachment of the latch plate 312 from the back plate 300. It should be noted that other latch plate 312 materials, shapes, and methods of coupling may be suitable to provide cover 104 securement to the back plate 300. The latch plate rivets 314 are installed flush with the exterior face of the back plate rear wall 304 so that the liquid dispenser 100 may be mounted flush against the vertical support in order to eliminate a possible pry point.

The back plate side walls 306 are generally shaped to provide the holding cavity, as noted above, and to overlap with an interior face of the front plate side walls 502 to prevent access to the interior of the dispenser 100, and reduce the possibility of ligation, when the dispenser 100 is in the closed position.

The back plate side walls 306 are narrowed proximate to the back housing bottom edge 318 and the back housing top edge 316 to allow the cover 104 to rotate into the closed position. The width of the back plate side walls 306 proximate to the back housing bottom edge 318 are of suitable width for including the hinge hole 322. The back plate side walls 306 also include the back plate front flanges 324 to provide additional restraint for the liquid cartridge 200 coupled to the back housing 102 and rigidity to the back housing 102.

The cartridge support assembly 302 is configured to support the liquid cartridge 200, allow for maintenance and replacement of the liquid cartridge 200, and maintain the pump 202 in the required location and orientation for activation by and dispensing through the actuator 108. The pump cutout 330 is configured for demountable coupling of the pump 202 to the cartridge support assembly 302, and is described further in FIGS. 4, 11.

Figure 4:
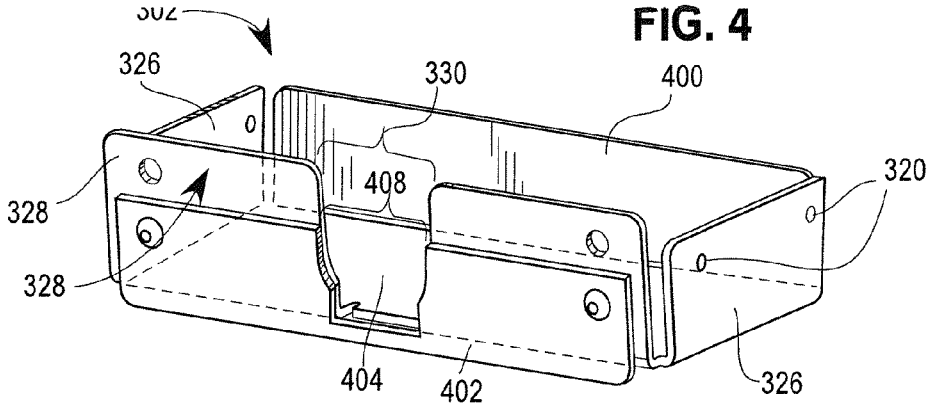
FIG. 4 is a perspective view of a cartridge support assembly of the liquid dispenser.

Referring next to FIG. 4, a perspective view of the cartridge support assembly 302 in one embodiment of the present invention is shown. Shown are the cartridge support assembly 302, the plurality of rivet holes 320, the plurality of cartridge support plate side walls 326, the cartridge support plate front wall 328, the pump cutout 330, a cartridge support plate 400, a pump shim plate 402, a cartridge support assembly base 404, and a pump shim plate cutout 408.

The cartridge support assembly 302 includes the cartridge support plate 400 and the pump shim plate 402. As shown above, the cartridge support plate 400 is shaped in a generally rectangular shallow tray shape, and is rivetedly coupled to the back plate side walls 306 so that the cartridge support assembly base 404 provides support for the liquid container 204.

The cartridge support plate front wall 328 forms the front side of the rectangular tray shape, and generally aligns with a plane of the back plate front flanges 324. The cartridge support plate front wall 328 includes the generally U-shaped pump cutout 330 extending from a top edge of the cartridge support plate front wall 328 to a bottom edge of the cartridge support plate front wall 328. The pump cutout 330 is configured for demountable coupling of the liquid cartridge 200 in a dispensing position.

In the present embodiment, the cartridge support plate front wall 328 location and angle with respect to the cartridge support assembly base 404 is configured to ensure that the pump 202 is in the correct dispensing position when the liquid dispenser 100 is in the closed position and the liquid dispenser 100 is locked.

The cartridge support assembly 302 includes the pump shim plate 402 rivetedly coupled to the front face of the cartridge support plate front wall 328. The pump shim plate 402 includes the pump shim plate cutout 408 in a shape aligning with the pump cutout 330 when the pump shim plate 402 is coupled to the cartridge support plate 400.

Referring again to FIG. 4, the cartridge support assembly 302 of the back housing 102 is shown. The cartridge support assembly 302 provides demountable coupling of the liquid cartridge 200 to the back housing 102. In the present embodiment, the pump 202 is a type manufactured by Rexam Airspray for use with a liquid container 204. The exemplary pump 202 includes a pump flange 1104 for sliding into the pump cutout 330 for coupling of the pump 202 to the liquid dispenser 100. The pump cutout 330 is configured to wedgingly receive the exemplary pump 202, but those skilled in the art will note that the cartridge support assembly 302 may be modified to accommodate alternate pumps and liquid cartridges. The liquid cartridge 200 is described further below in FIG. 11.

Also due to the configuration of the exemplary pump 202, the pump shim plate 402 is sized and located to provide a shim to the cartridge support plate front wall 328 in order to wedgingly couple the exemplary pump 202 to the cartridge support assembly 302. The pump shim plate 402 is shown riveted to the cartridge support plate 400, but alternate forms of coupling, for example screws or welding, may also be used. The pump shim plate 402 may not be required if alternate means for mounting the pump 202 are used.

The cartridge support assembly base 404 provides support for the liquid container 204 when the liquid dispenser 100 is in either the open or the closed position.

Figure 5:
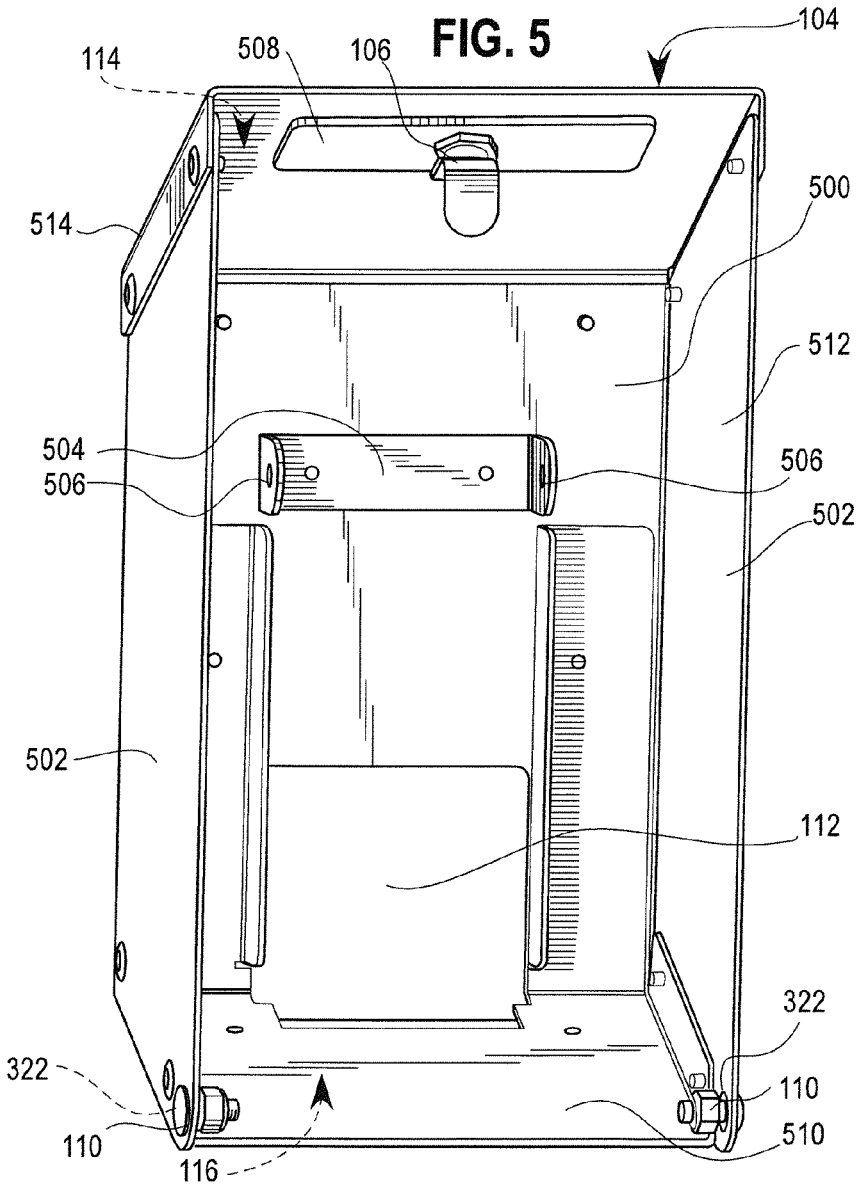
FIG. 5 is a perspective view of a cover of the liquid dispenser.

Referring next to FIG. 5, a perspective view of the interior of the cover in one embodiment of the invention is shown. Shown are the cover 104, the locking mechanism 106, the plurality of pivot bolts 110, the opening h112, the liquid dispenser bottom surface 116, the plurality of hinge holes 322, a front plate front wall 500, a plurality of front plate side walls 502, a pivot plate 504, a plurality of actuator pivot holes 506, a lock plate 508, a base plate 510, a front plate 512, and a top plate 514.

The front plate 512 is formed in a general vertical channel shape, where the front plate front wall 500 corresponds to the channel base and the two front plate side walls 502 correspond to the channel sides. Each front plate side wall 502 includes the hinge hole 322 proximate to a bottom rear corner of the front plate side wall 502.

The pivot plate 504 is generally channel-shaped, with the base of the channel coupled to an interior face of the front plate front wall 500 above the cover opening 112, the channel sides each including one actuator pivot hole 506 for pivotally coupling the actuator 108 to the pivot plate 504 using an actuator pivot bolt 1302 (as shown below in FIG. 13). In the present embodiment, the pivot plate 504 is welded to the front plate front wall 500. The front plate front wall 500 includes the cover opening 112 proximate to a bottom of the front plate front wall 500, as described further below in FIG. 6.

The top plate 514 is rivetedly coupled to a top edge of the front plate front wall 500 and a top edge of each front plate side wall 502, and includes the locking mechanism 106 and the lock plate 508. The top plate 514 is described further below in FIG. 7.

The base plate 510 is rivetedly coupled to the front plate front wall 500 above the cover opening 112 and to the front plate side walls 502 proximate to a bottom edge of each front plate side wall 502, and is described further below in FIG. 8.

Referring again to FIG. 5, the cover 104 is shown in one embodiment of the present invention as being comprised of the front plate 512, the top plate 514 and the base plate 510. The coupling of the front plate 512, the top plate 514 and the base plate 510 forms a generally trapezoidal prism shape, with the smaller trapezoidal prism base forming a front of the liquid dispenser 100 and the wider trapezoidal base open to receive the back housing 102 within the trapezoidal prism shape when the liquid dispenser 100 is in the closed position. The trapezoidal prism shape results in sloping of the liquid dispenser top surface 114 and the liquid dispenser bottom surface 116 when the liquid dispenser 100 is in the closed position.

The front plate side walls 502 are configured so that each rear vertical edge of the front plate 512 generally aligns with the exterior face of the back plate rear wall 304 when the liquid dispenser 100 is in the closed position, minimizing a ligation gap between the front plate side walls 502 and the vertical support. Likewise, the top plate 514 is configured so that a rear horizontal edge of the top plate 514 generally aligns with the exterior face of the back plate rear wall 304 when the liquid dispenser 100 is in the closed position. As a result, the possibility of tampering or ligation is prevented when the liquid dispenser 100 is mounted on the vertical support and in the closed position and locked configuration.

Due to the location of the pivot bolts 110 proximate to the liquid dispenser bottom surface 116, the bottom gap must be maintained between the cover 104 and the back housing 102 to allow the cover 104 to pivot relative to the back housing 102. The bottom gap is described further below in FIG. 10.

Figure 6:
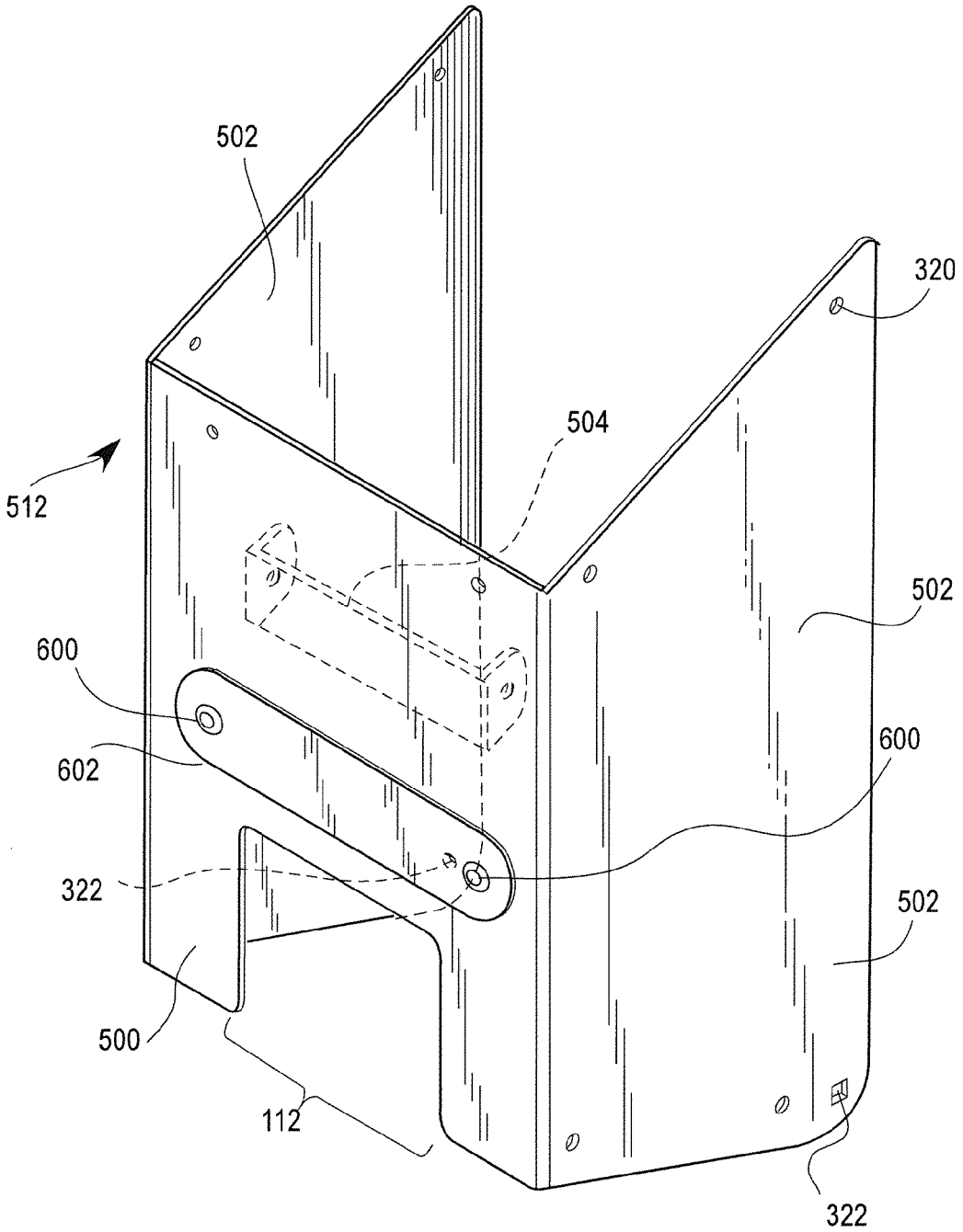
FIG. 6 is a perspective view of a front plate of the cover.

Referring next to FIG. 6, the front plate 512 of the cover 104 is shown. Shown are the plurality of rivet holes 320, the plurality of hinge holes 322, the front plate front wall 500, the plurality of front plate side walls 502, the pivot plate 504, the front plate 512, the plurality of rivets 600, and a cover reinforcing plate 602.

As described previously in FIG. 5, the front plate 512 is part of the generally trapezoidal prism shape. The front plate 512 includes the plurality of rivet holes 320 for coupling to the top plate 514 and to the base plate 510. The front plate 512 also includes the hinge hole 322 proximate to the bottom rear corner of each front plate side wall 502 for pivotally coupling the cover 104 to the back housing 102.

The front plate front wall 500 includes the generally rectangular cover opening 112 proximate to the bottom of the front plate front wall 500.

The cover reinforcing plate 602 is rivetedly coupled to an exterior face of the front plate front wall 500 above the cover opening 112 using the same rivets 600 as used for coupling the base plate front tabs 802 (as shown below in FIG. 8) to the interior face of the front plate front wall 500.

The pivot plate 504 is coupled to the interior face of the front plate front wall 500, as previously described in FIG. 5.

Referring again to FIG. 6, the front plate 512 of the cover 104 is shown according to one embodiment of the invention. The front plate 512 is shaped to provide minimal gaps between the front plate 512 and the back housing 102, the top plate 514 and the base plate 510 when the liquid dispenser 100 is in the closed position. The liquid dispenser bottom surface 116 and the liquid dispenser top surface 114 are sloped, preventing an item (not shown) from being placed on top of the liquid dispenser 100 when the liquid dispenser 100 is in the closed position.

The cover reinforcing plate 602 provides additional rigidity and structural strength to the front plate front wall 500, preventing deformation and tear-out of the front plate 512 if the actuator 108 is subject to a force causing outward leverage of the actuator 108 against the front plate 512 at the cover opening 112. The cover reinforcing plate 602 also provide additional stiffness and structural strength to the cover 104 where the stiffness and strength has been reduced due to the proximity of the cover opening 112.

Figure 7:
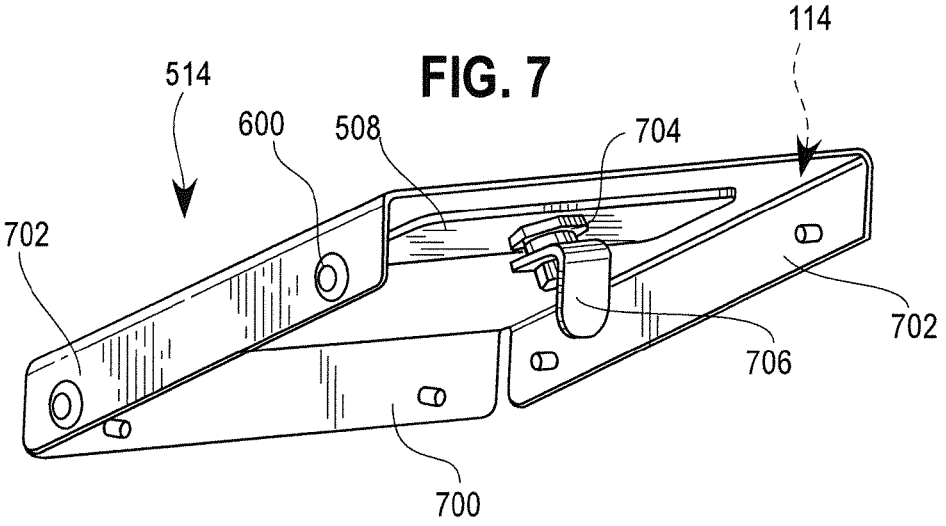
FIG. 7 is a perspective view of a top plate of the cover.

Referring next to FIG. 7, the top plate 514 of the cover 104 is shown according to one embodiment of the present invention. Shown are the liquid dispenser top surface 114, the lock plate 508, the top plate 514, the plurality of rivets 600, a top plate front flange 700, two top plate side flanges 702, a tubular cam lock 704, and a cam lever 706.

As previously described, the top plate 514 is rivetedly coupled to the front plate 512 to form the sloping top of the liquid dispenser 100. In the present embodiment, the top plate 514 includes three flanges, the top plate front flange 700 aligning generally with the front plate front wall 500 and each top plate side flange 702 aligning generally with one front plate side wall 502. The top plate flanges 700, 702 are oriented downward and riveted to the top edges of the front plate side walls 502 using the plurality of rivets 600. At each front vertical corner of the liquid dispenser 100, the vertical edges of the top plate flanges 700, 702 forming the corner are juxtaposed.

The locking mechanism 106 is coupled to the top plate 514 proximate to a rear edge of the front plate 512 such that a keyhole (not shown) is located on the liquid dispenser top surface 114. In the present embodiment the locking mechanism 106 is the tubular cam lock 704 including the L-shaped cam lever 706. The tubular cam lock 704 is locked and unlocked by a tubular key unlocking device (not shown). The locking mechanism 106 is located and configured so that when the tubular cam lock 704 is in the unlocked position, and the liquid dispenser 100 is in the closed position, locking the tubular cam lock 704 will rotate the cam lever 706 so that it is received by the latch plate 312 (shown in FIGS. 2-3) and the cover 104 is secured to the back housing 102.

The lock plate 508 is coupled to an interior face of the top plate 514 by sandwiching it between the shaft of the cam lock 704 and the top plate 514.

Referring again to FIG. 7, the top plate 514 is rivetedly coupled to the top edges of the front plate 512, providing a sloping surface which advantageously prevents an item from being placed on the liquid dispenser top surface 114, as previously shown in FIG. 6.

The top plate flanges 700, 702 are rivetedly coupled to the front plate 512 to prevent removal of or vandalism to the top plate 514. The vertical edges of the top plate flanges 700, 702 are juxtaposed at each front vertical corners of the liquid dispenser 100, preventing tampering with the liquid dispenser 100 by using a gap between the top plate flanges 700, 702 to pry up the top plate flanges 700, 702. The juxtaposition of the vertical edges of the top plate flanges 700, 702 also removes a ligation gap on the liquid dispenser 100, and prevents objects from being inserted through a corner gap into the interior of the dispenser 100 and puncturing the liquid container 204.

The tubular cam lock 704 coupled to the top plate 514 secures the cover 104 to the back housing 102 so that only authorized persons with the corresponding unlocking device (in this embodiment the tubular key unlocking device) may access the interior of the liquid dispenser 100. Those skilled in the art will recognize that locking mechanisms configured for alternate locking devices, such as a combination lock or a cut key lock, may be used.

The lock plate 508 coupled to the interior face of the top plate 514 at the locking mechanism 106 location provides additional structural strength to the top plate 514 to prevent pull-out of the locking mechanism 106 if the cover 104 is tampered with.

Figure 8:
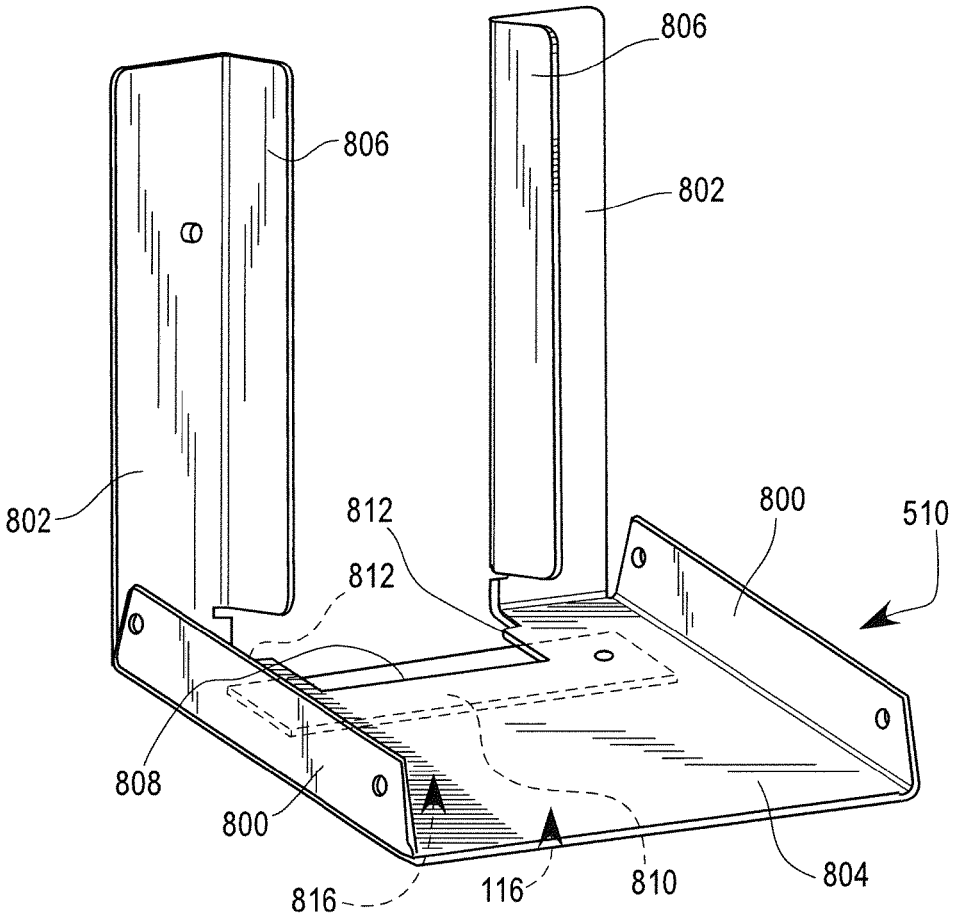
FIG. 8 is a perspective view of a base plate of the cover.

Referring next to FIG. 8, one embodiment of the base plate 510 is shown. Shown are the liquid dispenser bottom surface 116, the base plate 510, a base plate side flange 800, a plurality of base plate front tabs 802, a base plate bottom 804, a plurality of front tab flanges 806, a base plate notch 808, the base reinforcing plate 810, and a plurality of base plate notch shoulders 812.

As previously described in FIG. 5, the base plate 510 is rivetedly coupled to the front plate 512. The base plate bottom 804 includes the base plate side flange 800 located on each side of the liquid dispenser 100, each base plate side flange 800 overlapped with the bottom edge of the corresponding front plate side wall 502 to form two bottom side corners of the liquid dispenser 100. The base plate side flange 800 is configured to overlap with an interior face of the front plate side wall 502. In the present embodiment, the base plate side flanges 800 are coupled to the front plate side walls 502 using the plurality of rivets 600 (not shown). Rear edges of the base plate side flanges 800 are sloped linearly away from the rear of the liquid dispenser 100 to allow the cover 104 to pivot to the closed position without the base plate side flanges 800 contacting the back housing 102.

The base plate 510 includes the base plate front tabs 802 extending upward from a front edge of the base plate bottom 804 at an angle of approximately 20 degrees. Each base plate front tab 802 is configured so that an inner vertical edge of the base plate front tab 802 aligns with the extent of the cover opening 112 when the base plate 510 is coupled to the cover 104. An outer vertical edge of each base plate front tab 802 is configured so that the outer vertical edge of the base plate front tab 802 is adjacent to a proximate front vertical corner of the cover 104 when the base plate 510 is coupled to the front plate 512. Thus, the width of the base plate front tab 802 is generally equal to an interior width of the front plate front wall 500 proximate to the cover opening 112. Each base plate front tab 802 includes a front tab flange 806, extending inward from the inner vertical edge of the base plate front tab 802 (proximate to the cover opening 112), in a generally perpendicular direction. In the present embodiment, the front tab flange 806 extends from a top edge of the base plate front tab 802 downward to a location proximate to the base plate bottom 804.

The base plate 510 includes the base plate notch 808, located in a center front portion of the base plate bottom 804. The base plate notch 808 is stepped inward towards the rear of the base plate bottom 804, such that a front portion of the base plate notch 808 is wider that a rear portion of the base plate notch 808, forming the base plate notch shoulder 812. The extent of the front portion of the base plate notch 808 is configured to align with the cover opening 112 when the front plate 512 is coupled to the base plate 510.

The base reinforcing plate 810 is rivetedly coupled to an exterior face of the base plate bottom 804. The base reinforcing plate 810 is generally rectangular in shape, and oriented to cover a longitudinal rear portion of the base plate notch 808.

Referring again to FIG. 8, the base plate 510 of the cover 104 is shown. The base plate 510 is configured to provide flush bottom corners and to be coupled to at least one interior face of the front plate 512, in order to provide additional structural strength to the cover 104 to discourage and prevent tampering. In addition, the base plate front tabs 802 coupled to the interior face of the front plate front wall 500 proximate to the cover opening 112 provide additional structural strength to the front plate 512 at a comparatively weak area of the front plate 512. The front tab flanges 806 provide even more structural strength to the front plate front wall 500, and also prevent access to the interior of the liquid dispenser 100 when the actuator 108 is rotated inwards, which would otherwise form a ligation gap between the front plate front wall 500 and the actuator 108.

The base plate notch 808 is configured for receiving the actuator 108 in both the at-rest and actuated positions. The base plate notch shoulders 812 halts the rotation of the actuator 108 when the actuator 108 contacts the base plate notch shoulder 812 as the actuator 108 is pushed inward. This prevents damage of the pump 202 due to excessive force on the pump 202 when the actuator 108 is pushed inward.

The base plate notch 808 is also sized to minimize a ligation gap between the actuator 108 and the base plate notch 808 during operation of the liquid dispenser 100, to prevent tampering with the liquid dispenser 100 or ligation using external materials wedged in the gap. In addition, the base reinforcing plate 810 is coupled to the exterior face of the base plate bottom 804, partially overlapping the base plate notch 808. The base reinforcing plate 810 adds structural strength to the base plate 510 at a location weakened by the base plate notch 808, and also minimizes an actuator bottom ligation gap between the actuator 108 and the base plate bottom 804 when the actuator 108 is rotated inward, preventing tampering and ligation.

Figure 9:
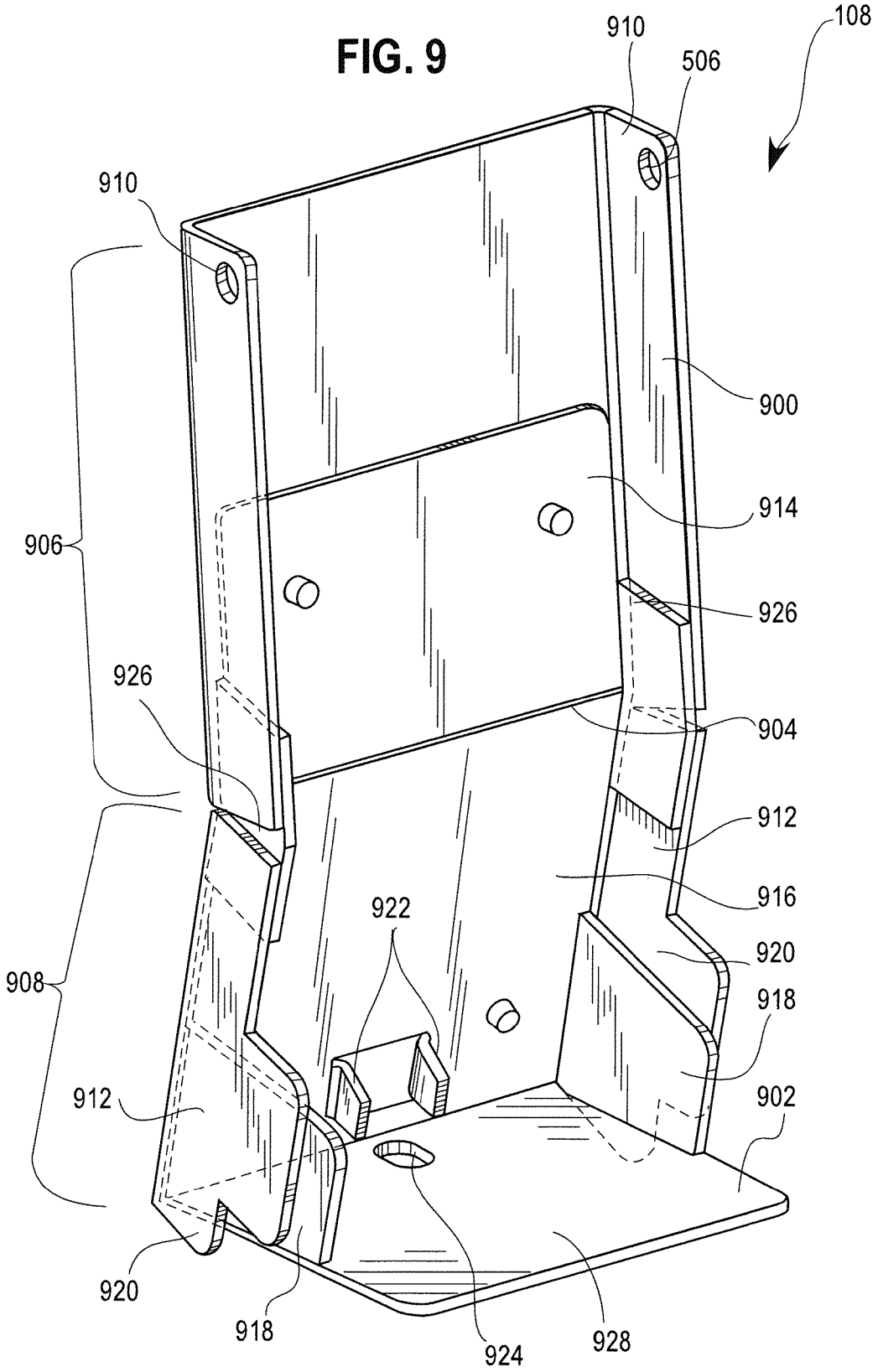
FIG. 9 is a perspective view of the actuator of the liquid dispenser.

Referring next to FIG. 9, the actuator 108 is shown in one embodiment of the invention. Shown are the actuator 108, the plurality of actuator pivot holes 506, a top actuator plate 900, a pump guide 902, a horizontal bend 904, a top actuator plate top segment 906, a top actuator plate bottom segment 908, a plurality of top segment side flanges 910, a plurality of bottom segment side flanges 912, a pump guide top segment 914, a pump guide middle segment 916, a plurality of pump guide side flanges 918, a plurality of bottom tabs 920, a plurality of guide tabs 922, a dispensing hole 924, and a plurality of gusset plates 926.

As previously shown in FIG. 1, the actuator 108 is pivotally coupled, proximate to a top edge of the actuator 108, to the interior face of the front plate front wall 500 and is partially accessible through the cover opening 112.

The actuator 108 is comprised of two primary members: the top actuator plate 900 and the pump guide 902. An exterior face of the top actuator plate 900 is oriented generally parallel to the front plate front wall 500. The pump guide 902 forms a general L-shape, with a vertical portion of the pump guide 902 rivetedly coupled to the interior face of the top actuator plate 900, and a horizontal portion of the pump guide 902 extending inward towards the rear of the liquid dispenser 100.

The top actuator plate 900 includes the outward horizontal bend 904, of approximately 15 degrees, located proximate to a vertical midpoint of the top actuator plate 900, such that when the actuator 108 is coupled to the cover 104, a bottom portion of the actuator 108 extends outward past a perimeter of the cover 104. The top actuator plate top segment 906 is defined as a portion of the top actuator plate 900 located above the horizontal bend 904, and the top actuator plate bottom segment 908 is defined as a portion of the top actuator plate 900 located below the horizontal bend 904.

The top actuator plate top segment 906 includes the integral top segment side flanges 910 at each vertical edge of the top actuator plate top segment 906. Each top segment side flange 910 extends inward from the top actuator plate top segment 906 in a generally perpendicular direction. Each top segment side flange 910 includes the actuator pivot hole 506 proximate to a top edge of the top segment side flange 910.

The top actuator plate bottom segment 908 also includes integral bottom segment side flanges 912 at each vertical edge of the top actuator plate bottom segment 908, similar in orientation to the top segment side flanges 910. Due to the horizontal bend 904, a gap between a bottom edge of the top segment side flange 910 and a top edge of the proximate bottom segment side flange 912 forms a V-shape, with the point of the V coinciding with the horizontal bend 904 location. The bottom segment side flanges 912 each include a bottom tab 920 proximate to a bottom edge of each bottom segment side flange 912.

Two chevron-shaped gusset plates 926 are coupled to the top actuator plate 900. The angle of each gusset plate 926 is configured to approximately match an angle between the top actuator plate top segment 906 and the top actuator plate bottom segment 908. Each gusset plate 926 is coupled to both a bottom portion of the top segment side flange 910 and a top portion of the bottom segment side flange 912, thus coupling each top segment side flange 910 to the proximate bottom segment side flange 912 and covering the V-shaped gap between the side flanges 910, 912.

The pump guide 902 includes three integral segments forming a general L-shape. A lower end of the pump guide top segment 914 is integrally coupled to an upper end of the pump guide middle segment 916, forming the generally vertical portion of the L-shape. The pump guide top segment 914 and the pump guide middle segment 916 are coupled at an angle to match the angle between the top actuator plate top segment 906 and the top actuator plate bottom segment 908. The pump guide bottom segment 928 is coupled to a lower end of the pump guide middle segment 916, the pump guide bottom segment 928 extending inward at an angle of approximately 80 degrees, forming the generally horizontal portion of the L-shape. Each pump guide side flange 918 is coupled to a lower side portion of each pump guide middle segment 916 proximate to the pump guide bottom segment 928, and extends generally vertically inward along a portion of a horizontal edge of the pump guide bottom segment 928, forming a generally horizontal corner where the lower edge of the pump guide side flange 918 abuts a horizontal edge of the pump guide bottom segment 928.

The pump guide middle segment 916 includes two vertical guide tabs 922 formed by cutting an I-shape into the pump guide middle segment 916 and folding the resulting guide tabs 922 inward. The guide tabs 922 are located such that a pump nozzle 1106 is between the guide tabs 922 when the cover 104 is in the closed position.

The pump guide bottom segment 928 includes the oval dispensing hole 924 located proximate to a front edge of the actuator 108. The dispensing hole 924 is equidistant from each guide tab and is located in a position suitable for dispensing of the liquid from the pump nozzle 1106 through the dispensing hole 924 when the cover 104 is in the closed position, as shown below in FIG. 12). The configuration of the dispensing hole 924 is the minimum required to allow the liquid to be entirely dispensed through the dispensing hole 924 when the pump nozzle 1106 includes a nozzle insert 1108 as described further below in FIGS. 11, 12.

Referring again to FIG. 9, the actuator 108 is shown. The actuator 108 is comprised of two members, the top actuator plate 900 and the pump guide 902. The top actuator plate 900 forms a continuous generally vertical exterior surface to the actuator 108, preventing prying. The pump guide 902 is coupled to an interior face of the top actuator plate 900, increasing the structural strength of the actuator 108, preserving the continuous surface of the actuator 108, and providing the guide tabs 922 for aligning the pump nozzle 1106 with the dispensing hole 924. The pump guide 902 also forms a generally continuous underside of the actuator 108, preventing access to and possible tampering with the liquid cartridge 200.

The coupling of the pump guide 902 to the top actuator plate 900 also advantageously increases the structural strength and resistance to deformation of the actuator 108, preventing removal of the actuator 108 due to bending of the actuator 108. A lower edge of the top actuator plate 900 is configured to form a salient corner with the pump guide 902, preventing prying of the top actuator plate 900 with respect to the pump guide 902.

The top edge of each top segment side flange 910 is pivotally coupled to the interior face of the front plate front wall 500, so as to provide pressure to the pump 202, thus actuating the pump 202, when the actuator 108 is pushed inward. The top actuator plate 900 includes the top segment side flanges 910 and the bottom segment side flanges 912 to provide additional structural strength and stiffness to the actuator 108, and to prevent access to the interior of the liquid dispenser 100 when in the closed position.

The top actuator plate bottom segment 908 is coupled relative to the top actuator plate top segment 906 to provide a pushing surface that projects from the perimeter of the cover 104, while the top actuator plate top segment 906 remains generally parallel to the perimeter of the cover 104.

The gusset plates 926 coupling each top segment side flange 910 to the proximate bottom segment side flange 912 provide additional reinforcement and structural strength to the top segment side flanges 910 and bottom segment side flanges 912 to reduce the likelihood of removal of the actuator 108 from the liquid dispenser 100 due to tampering.

The bottom segment side flanges 912 each include the bottom tab 920 to provide additional closure to the actuator 108 when the actuator 108 is in the outmost position, prevent objects from being inserted into the dispenser 100, and to strengthen the actuator 108 against prying forces or forces aimed at bending the actuator 108 to gain access to the dispenser 100 interior.

The pump guide 902 forms the underside of the actuator 108, and includes the dispensing hole 924. As described further below, the dispensing hole 924 is intentionally small in order to prevent a ligation gap at the dispensing hole 924 location. As a result, the margin of error of placement of the pump nozzle 1106 relative to the dispensing hole 924 is small. To ensure the correct pump nozzle 1106 placement, the guide tabs 922 included in the pump guide 902 align and hold the pump nozzle 1106 in a position required to align the nozzle discharge with the dispensing hole 924.

Figure 10:
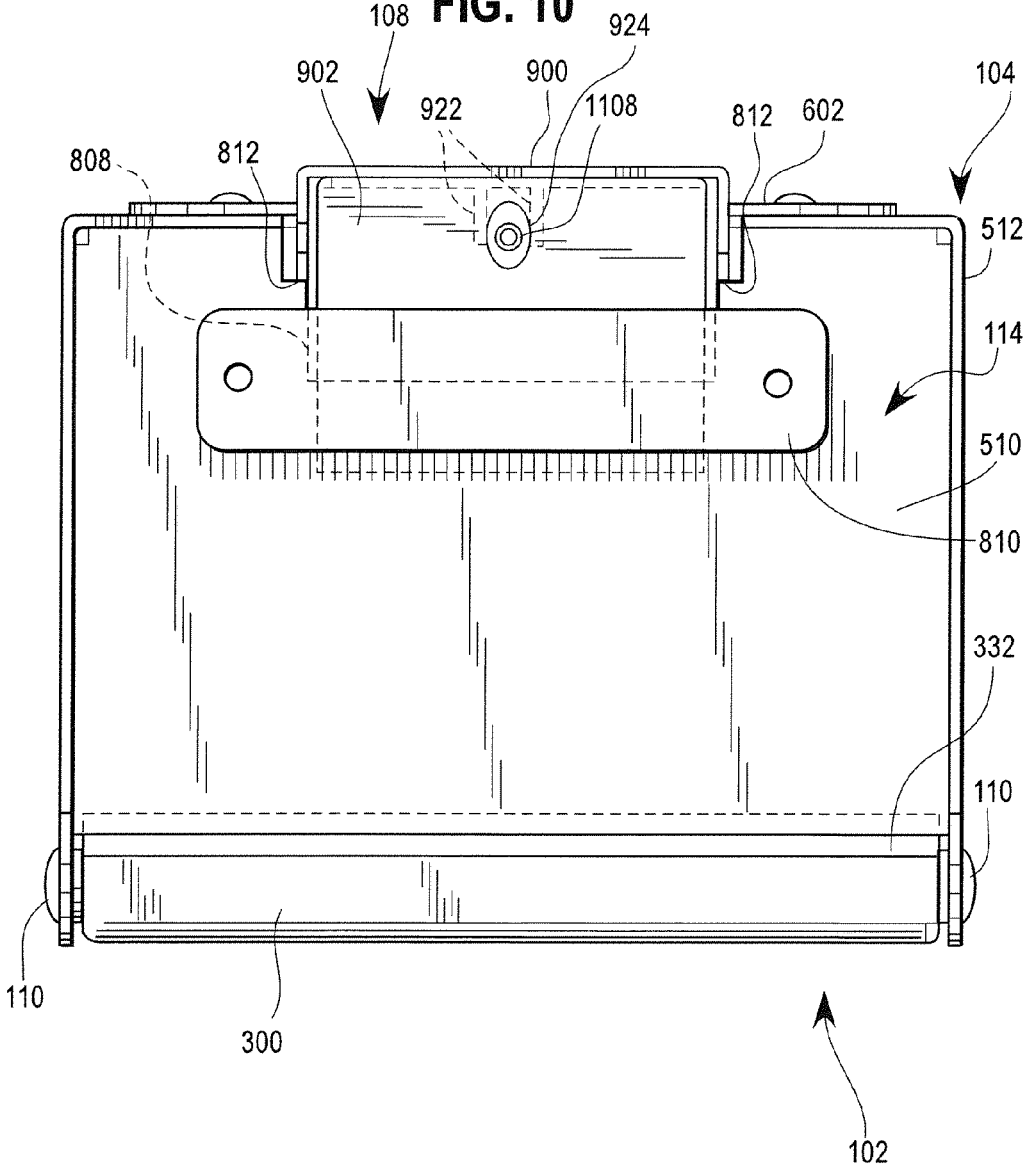
FIG. 10 is a bottom plan view of a bottom surface of the liquid dispenser.

Referring next to FIG. 10, the liquid dispenser bottom surface 116 is shown. Shown are the back housing 102, the cover 104, the actuator 108, a plurality of pivot bolts 110, the back plate 300, the back plate bottom flange 332, the base plate 510, the front plate 512, the cover reinforcing plate 602, the base plate notch 808, the base reinforcing plate 810, the base plate notch shoulders 812, the top actuator plate 900, the pump guide 902, the plurality of guide tabs 922, the dispensing hole 924, and the nozzle insert 1108.

As previously described, the liquid dispenser 100 is configured to dispense the liquid through the dispensing hole 924 when the actuator 108 is pushed inward and the pump 202 is activated. The guide tabs 922 of the pump guide 902, shown on either side of the pump nozzle 1106, maintain the pump nozzle 1106 in the position necessary to align the pump nozzle 1106 with the dispensing hole 924.

The base reinforcing plate 810 is shown overlapping with the base plate notch 808 to minimize the actuator gap formed between the pump guide 902 and the base plate 510 when the actuator 108 is pushed inward, thus preventing a ligation gap and tampering. Similarly, the back plate bottom flange 332 is shown overlapping with the interior face of a rear portion of the base plate 510 to prevent a ligation gap between the back plate 300 and the base plate 510 at the hinge location.

The generally horizontal portion of the pump guide 902 is shown extending past a rear edge of the base plate notch 808, preventing access to the rear edge of the pump guide 902 when the actuator 108 is rotated outward until it contacts the front plate 512, thus preventing possible vandalism to or removal of the actuator 108 from the liquid dispenser 100.

Figure 11:
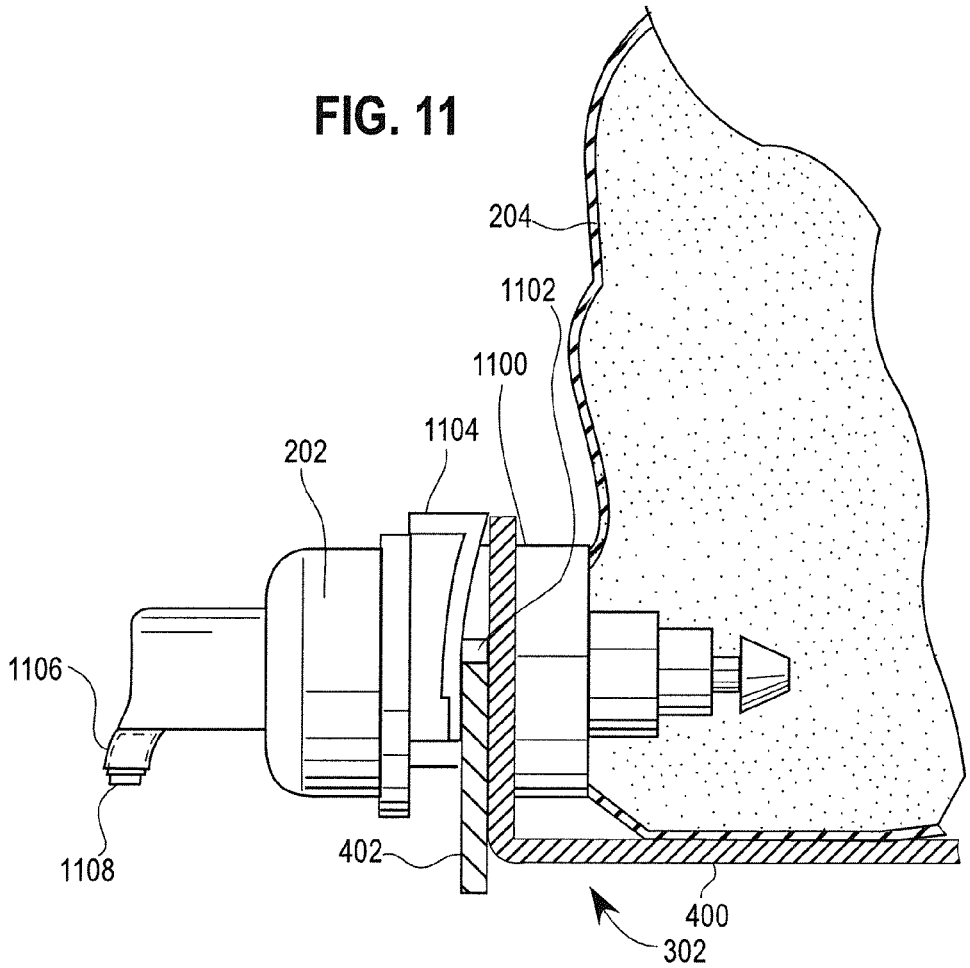
FIG. 11 is a sectional view of a pump of the liquid dispenser.

Referring next to FIG. 11, the pump 202 is shown coupled to the cartridge support assembly 302 in one embodiment of the present invention. Shown are the pump 202, the liquid container 204, the cartridge support assembly 302, the pump shim plate 402, the nozzle insert 1108, a pump body 1100, a pump notch 1102, a pump flange 1104, and the pump nozzle 1106.

The pump 202 is demountably coupled to the cartridge support assembly 302 by sliding the pump body 1100 downward into the pump cutout 330 so that the pump notch 1102 is coupled to the pump shim plate 402 and the cartridge support plate 400 at the pump cutout 330, and the pump flange 1104 is wedgingly coupled to a front face of the cartridge support plate front wall 328 and a front face of the pump shim plate 402. Those skilled in the art will note that alternate pump types and pump mounting configurations may be used instead of the pump type and pump mounting configuration shown.

The pump nozzle 1106 includes the nozzle insert 1108, which is wedgingly coupled to the interior of the pump nozzle 1106. The nozzle insert 1108 is comprised of a compressible plastic material, for example, a thermoplastic elastomeric material. When the nozzle insert 1108 is coupled to the pump nozzle 1106, a lower portion of the nozzle insert 1108 projects from the pump nozzle 1106. The nozzle insert 1108 is described further below in FIG. 12.

Referring again to FIG. 11, the pump 202 is demountably coupled to the cartridge support assembly 302 to allow for replacement of the liquid cartridge 200 while also securing the pump 202 in the required location for dispensing the liquid through the dispensing hole 924.

The nozzle insert 1108 reduces the diameter of a liquid stream dispensed from the pump nozzle 1106, as the liquid stream diameter dispensed from the pump 202 lacking the nozzle insert 1108 would be too wide for the entire liquid stream to exit through the dispensing hole 924. In the present embodiment, the pump 202 is a liquid-to-foam type pump, but it will be apparent to those with ordinary skill in the art that the reduction in diameter applies equally to a foam stream. The nozzle insert 1108 is described further below in FIG. 12.

Figure 12:
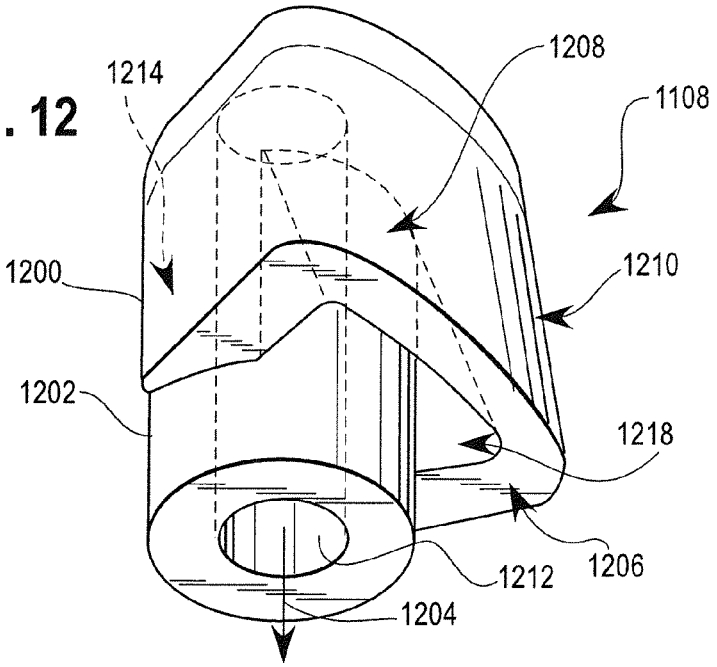
FIG. 12 is a perspective view of the pump nozzle insert.

Referring next to FIG. 12, a perspective view of the nozzle insert 1108 is shown in one embodiment of the invention. Shown are the nozzle insert 1108, a body segment 1200, a projection segment 1202, a direction of liquid flow 1204, an outer edge 1206, an exterior surface 1208, a front surface 1210, a dispensing bore 1212, and a rear corner 1214.

In the present embodiment, the nozzle insert 1108 comprises thermoplastic elastomeric material. The nozzle insert 1108 includes the body segment 1200 and the projection segment 1202. The body segment 1200 is shaped to wedgingly fit within the pump nozzle 1106. In the present invention, the body segment 1200 is in a general triangular prism shape, with the longitudinal axis of the prism parallel to the direction of liquid flow 1204 through the nozzle insert 1108. The body segment 1200 includes the outer edge 1206, corresponding to the end of the triangular prism shape distal to the pump nozzle 1106.

The projection segment 1202 is integrally coupled to the outer edge 1206 and is generally tubular in shape. The nozzle insert 1108 exterior surface 1208 is configured so that when the body segment 1200 is wedgingly received in the pump nozzle 1106, the outer edge 1206 generally aligns with the edge of the pump nozzle 1106, and the projection segment 1202 projects outward from the pump nozzle 1106.

The front surface 1210 of the nozzle insert 1108 corresponds to a face of the triangular prism that faces generally outward when the pump 202 is coupled to the liquid dispenser 100. The front surface 1210 is formed in a slightly convex shape.

The nozzle insert 1108 includes the dispensing bore 1212. The longitudinal axis of the center of the dispensing bore 1212 is located proximate to the body segment rear corner 1214 located proximate to the rear of the liquid dispenser 100 (not shown) when the pump 202 is installed in the liquid dispenser 100. The dispensing bore 1212 is approximately 0.087" in diameter.

The nozzle insert 1108 includes the cavity 1218 in a portion of the body segment 1200 proximate to the outer edge 1206. The cavity 1218 is located proximate to the front surface 1210 of the nozzle insert 1108.

Referring again to FIG. 12, as previously described, the nozzle insert 1108 decreases the diameter of the liquid stream so that the liquid stream is dispensed through the narrow dispensing hole 924 in the actuator 108. The nozzle insert 1108 is comprised of a thermoplastic elastomeric material, providing flexibility and durability. The combination of material flexibility and the nozzle insert 1108 shape results in a watertight seal between the exterior surface 1208 of the nozzle insert 1108 and the pump nozzle 1106, preventing liquid leakage between the pump nozzle 1106 and the nozzle insert 1108. Those skilled in the art will recognize that the nozzle insert may comprise other suitably flexible and durable materials, for example, rubber.

The front surface 1210 is formed in a shape that is slightly more convex than a shape of a front interior surface of the pump nozzle 1106. In addition, the cavity 1218 proximate to the front surface 1210 allows for greater flexibility of movement of the front surface 1210. As a result, when the nozzle insert 1108 is inserted into the pump nozzle 1106, the front surface 1210 is compressed and moves towards the dispensing bore 1212, resulting in a less convex shape and providing a tight seal between the front surface 1210 and the front interior surface for the pump nozzle 1106. The resulting compression also pushes out the other sides of the body segment 1200, providing a tight seal between the pump nozzle 1106 and all sides of the body segment 1200, preventing liquid leakage when the pump 202 is actuated.

The dispensing bore 1212 diameter is configured to provide the maximum rate of liquid flow while providing a liquid stream diameter small enough to entirely flow through the dispensing hole 924, as previously noted.

The projection segment 1202 projects from the edge of the pump nozzle to extend the dispensing bore 1212 to a location adjacent to the dispensing hole 924 so that the liquid stream remains compressed until just before it passes through the dispensing hole 924. As the liquid stream will widen gradually once it leaves the dispensing bore 1212, the projection segment 1202 allows the dispensing hole 924 to be made smaller than if the projection segment 1202 were not included and the liquid stream widened before passing through the dispensing hole 924. The smaller dispensing hole 924 is necessary to prevent ligation using the dispensing hole 924. In the present embodiment, the dispensing hole 924 is configured to prevent a knot in a standard showlace from being passed through the dispensing hole 924. Those skilled in the art will note that the dispensing hole may be configured to prevent other articles from being passed through the dispensing hole 924.

As noted previously, the exemplary pump 202 is a liquid-to-foam pump, resulting in the foam stream dispensed from the pump 202. As the foam stream expands more quickly than the comparative liquid stream, the projection segment 1202 allows the foam to pass through the dispensing hole 924 immediately after exiting the nozzle insert 1108, allowing the foam stream to entirely exit the liquid dispenser 100 while still accommodating the small dispensing hole 924.

Figure 13:
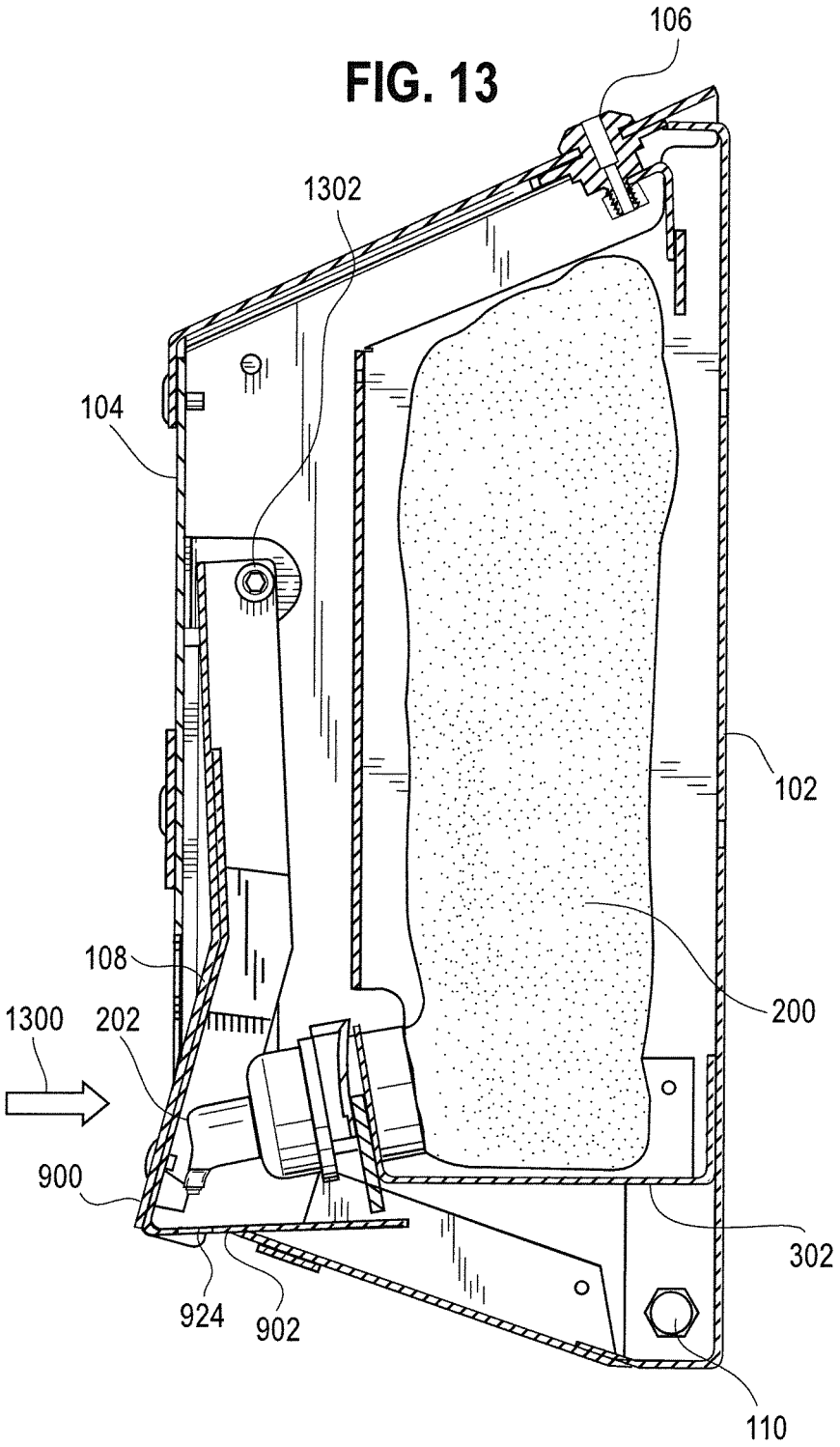
FIG. 13 is a sectional view taken along the line 1-1 in FIG. 1 showing the dispenser in the closed position.

Referring next to FIG. 13, a cross-sectional view of the liquid dispenser 100 with the liquid cartridge 200 installed is shown. Shown are the back housing 102, the cover 104, the locking mechanism 106, the actuator 108, the pivot bolt 110, the liquid cartridge 200, the pump 202, the cartridge support assembly 302, the top actuator plate 900, the pump guide 902, the dispensing hole 924, the nozzle insert 1108, an activation force arrow 1300, and an actuator pivot bolt 1302.

As previously described, the liquid dispenser 100 is operated when the actuator 108 is pushed inward (as indicated by the activation force arrow 1300), causing the actuator 108 to pivot at the actuator pivot holes 506 and rotate inward towards the back housing 102, pushing in a movable portion of the pump 202 and dispensing the liquid through the pump nozzle 1106, through the nozzle insert 1108, through the dispensing hole 924 and then to the user. The pump 202, including the nozzle insert 1108, does not extend past the perimeter of the liquid dispenser 100, in order to prevent tampering of the pump 202 or nozzle insert 1108. The combination of the nozzle insert 1108 and the dispensing hole 924 allow for dispensing of the liquid through the small dispensing hole 924 while still using a standard pump 202, while reducing the size of the dispensing hole 924 in order to prevent a ligation point.

While the invention herein disclosed has been described by means of specific embodiments, examples and applications thereof, numerous modifications and variations could be made thereto by those skilled in the art without departing from the scope of the invention set forth in the claims.

What is claimed is:

1. An apparatus for dispensing a liquid stream comprising:

a back housing comprising a back plate and a cartridge support assembly coupled to the back plate;

a latch plate coupled to the back plate;

a cover including a cover opening proximate to a lower portion of the cover, the lower portion of the cover pivotally coupled to a lower portion of the back housing such that the cover automatically pivots away from the back housing into an open position, and such that the apparatus defines an enclosed space configured for enclosing a container when the cover is in the closed position, the cover further comprising a base reinforcing plate coupled to an underside of the cover such that at least a portion of the cover opening located in the underside of the cover is covered, whereby a ligation gap between the actuator and the underside of the cover is covered, and whereby the structural strength of the base plate to resist an applied force is increased;

a latch coupled to the cover, whereby the latch may be removably coupled to the latch plate when the cover is in the closed position such that the cover is secured to the back housing in the closed position; and an actuator including a dispensing hole, the actuator pivotally coupled to an interior face of the cover such that a lower portion of the actuator is accessible through the cover opening, the actuator configured to dispense a liquid stream from a liquid container.

* * * * *